US005657698A

United States Patent [19]

Black, Jr. et al.

[11] Patent Number: 5,657,698

[45] Date of Patent: Aug. 19, 1997

[54] PIVOT PLATE ASSEMBLY FOR ARTICULATED RAILWAY CARS

[75] Inventors: James E. Black, Jr., Trenton; Donald J. Blunden, Plymouth; Michael J. Rench, Wyandotte, all of Mich.; Ralph H. Schorr, Lawrenceville, Ga.

[73] Assignee: Thrall Car Manufacturing Company, Chicago Heights, Ill.

[21] Appl. No.: 558,681

[22] Filed: Nov. 16, 1995

[51] Int. Cl.[6] ..... B61D 3/02; B61D 3/10

[52] U.S. Cl. ..... 105/3; 105/4.1; 105/8.1; 105/355; 414/340

[58] Field of Search ..... 105/3, 4.1, 8.1, 105/355, 375, 425, 458; 414/339, 340, 345; 14/2.4, 69.5, 71.1

[56] References Cited

U.S. PATENT DOCUMENTS

| | | | |
|---|---|---|---|
| 1,535,799 | 4/1925 | Adams . | |
| 3,290,058 | 12/1966 | Ellerd | 105/4.1 |
| 3,323,472 | 6/1967 | Boone et al. | 14/71.1 |
| 4,191,107 | 3/1980 | Ferris et al. | 105/4.1 |
| 4,503,779 | 3/1985 | Chadwick . | |
| 4,671,714 | 6/1987 | Bennett | 105/3 |
| 4,721,426 | 1/1988 | Bell et al. | 105/458 |
| 4,751,882 | 6/1988 | Wheatley et al. | 105/4.1 |
| 4,929,132 | 5/1990 | Yeates et al. | 410/56 |
| 5,010,614 | 4/1991 | Braemert et al. | 14/71.1 |
| 5,174,211 | 12/1992 | Snead | 105/3 |
| 5,392,717 | 2/1995 | Hesch et al. | 105/4.1 |

FOREIGN PATENT DOCUMENTS 2318369 10/1974 Germany .

OTHER PUBLICATIONS

Information sheet entitled "Trailer Train Company Prototype 156' Articulated Bi-Level Auto Rack Car" (1991).

Santa Fe brochure entitled "Introducing The Articulated Autoveyor", undated.

Statement of James E. Black, Jr. concerning testing of invention, dated Apr. 30, 1996.

*Primary Examiner*—S. Joseph Morano

*Attorney, Agent, or Firm*—Fitch, Even, Tabin & Flannery

[57] ABSTRACT

A pivot plate assembly for supporting vehicles over the articulation between pivotably interconnected railway car units, and allowing rolling transport of vehicles from one railway car unit to the next. Platforms are pivotably attached to respective railway car units adjacent their interconnected ends. A vehicle has its front end portion secured to one of the pivotal platforms and its rear end portion secured to the other platform while the platforms are oriented collinearly with respect to one another. The vehicle thereby maintains the pivotal platforms collinear with one another as the railway car units pivot with respect to one another. Accordingly, the pivotal platforms remain substantially stationary with respect to the vehicle supported thereon throughout pivotal movement of the railway car units to stably support the vehicle straddling the articulation between pivotably interconnected railway car units during transport. Bridge plates are slidably engaged to both of the railway car units and span the pair of pivotal platforms to allow rolling transport of vehicles over the articulation from one railway car unit to the next. The platform assembly remains in place throughout loading, transport, and unloading of vehicles. Each of the pivotal platforms and bridge plates may comprise one or more molded polymeric structures having a ribbed bottom surface to provide light weight, high strength, and durability.

20 Claims, 9 Drawing Sheets

PIVOT PLATE ASSEMBLY FOR ARTICULATED RAILWAY CARS

FIELD OF THE INVENTION

The present invention pertains to railway cars and, more particularly, to railway cars for transporting vehicles.

BACKGROUND OF THE INVENTION

Railway transport is commonly employed as a cost-effective method of shipping vehicles such as automobiles, vans, and the like. Vehicles are loaded end to end within each railway car and the doors on the ends of the railway cars slid closed during transport. In some cases, depending on the lengths of the vehicles, the vehicles may occupy substantially all of the available space in the railway car. In other cases, however, with a plurality of vehicles loaded onto a railway car, there may be several feet of unusable space left in the railway car. For instance, after several vehicles have been loaded onto a railway car, there may be a half-vehicle length of space left between the end vehicle and the end of the railway car. More typically, the vehicles are spaced out more evenly within the railway car if there is not enough length for another vehicle rather than leaving all the excess room at one end of the car. In either loading arrangement, a significant amount of space may be left unused on the railway cars.

It is a general object of the invention to enable more efficient use of space on auto rack cars.

Another general object of the invention is to facilitate loading and unloading of vehicles.

It is known to provide an articulated railway car having a pair of pivotably interconnected railway car units and to load vehicles into the interconnected railway car units by loading the vehicles into the trailing unit and rolling the vehicles through the interior of the trailing unit to the front unit or any other desired location. To allow rolling transport of the vehicles from one railway car unit to the next over the gaps between interconnected units, portable bridge plates are attached to span the adjacent ends of the interconnected units, with one bridge plate on either side of the car's centerline.

It is an object of the invention to facilitate loading and unloading of vehicles by enabling rolling transport of vehicles across the articulation between adjacent railway units and provide the capability of being able to transport the car with a vehicle spanning the articulation area.

SUMMARY OF THE INVENTION

In accordance with the present invention, a pivot plate assembly is provided for spanning a pair of pivotably joined vehicle-transporting units of a railway car at their articulation to support a vehicle having a front portion and a rear portion straddling the articulation during transport. The pivot plate assembly provides a support surface which remains substantially stationary with respect to the vehicles supported thereon during pivotal movement of the railway car units with respect to one another to stably support the vehicle straddling the articulation during pivotal movement of the railway car units with respect to one another between a straight position in which the units are generally collinear with respect to one another and a curved position in which the units are angled with respect to one another. A first platform is pivotably engaged to the first of two adjacent units of the railway car adjacent the end thereof adjoined to the second unit of the railway car. This allows pivotal movement of the first platform between a straightened position in which the longitudinal axis of the first platform is aligned with the longitudinal axis of the first unit of the railway car, and an angled position in which the longitudinal axis of the first platform extends at an angle with respect to the longitudinal axis of the first unit. Likewise, a second platform is pivotably engaged to the second unit of the railway car adjacent the end thereof adjoined to the first unit to allow pivotal movement of the second platform between a straightened position in which the axis of the second platform is aligned with the axis of the second unit of the railway car, and an angled position in which the axis of the second platform is angled with respect to the axis of the second unit. The front portion of the vehicle straddling the articulation is supportable upon and engageable with the first platform, and the rear portion of the vehicle straddling the articulation is supportable upon and engageable with the second platform, or vice-versa.

Engagement of the front and rear portions of the vehicle with respective first and second platforms maintains the first and second platforms in substantially collinear relation to one another during pivotal movement of the first and second units of the railway car with respect to one another between their straightened and angled positions. Thus, the pivotal platforms remain substantially stationary with respect to the vehicle supported thereon while the railway car units pivot beneath their respective platforms, whereby the pivotal platforms stably support the vehicle straddling the articulation during transport.

A vehicle may also have one pair of wheels, e.g., its front wheels, secured to the car unit deck with the other pair of wheels, e.g. the rear wheels, secured to the pivotal platform. With this loading arrangement, the deck of the unit and its respective pivotal platform remain substantially stationary with respect to each other and with respect to the vehicle supported thereon, and the vehicle may be positioned so that it extends to the end of the unit, or may have portions extending beyond the end of the unit in which its wheels are supported, into the interior of the next unit.

The pivot plate assembly also may comprise bridge plates for spanning the gap between the respective first and second units of the railway car. The bridge plates provide supporting surfaces for rolling of vehicles over the articulation from one of the platforms to the other to facilitate rolling loading and unloading of vehicles from one unit to another.

The platforms may partially overlap the bridge plates to provide a continuous, uninterrupted movable support surface to be provided adjacent the articulation. Each of the platforms preferably comprises one or more molded polymeric structures having a ribbed bottom surface to provide light weight while maintaining high strength and rigidity. Similarly, each of the bridge plates may be a molded polymeric structure having a ribbed bottom surface.

BRIEF DESCRIPTION OF THE DRAWINGS

In the drawings, wherein like elements are referenced alike.

DETAILED DESCRIPTION OF THE PREFERRED EMBODIMENTS

Figure 1:
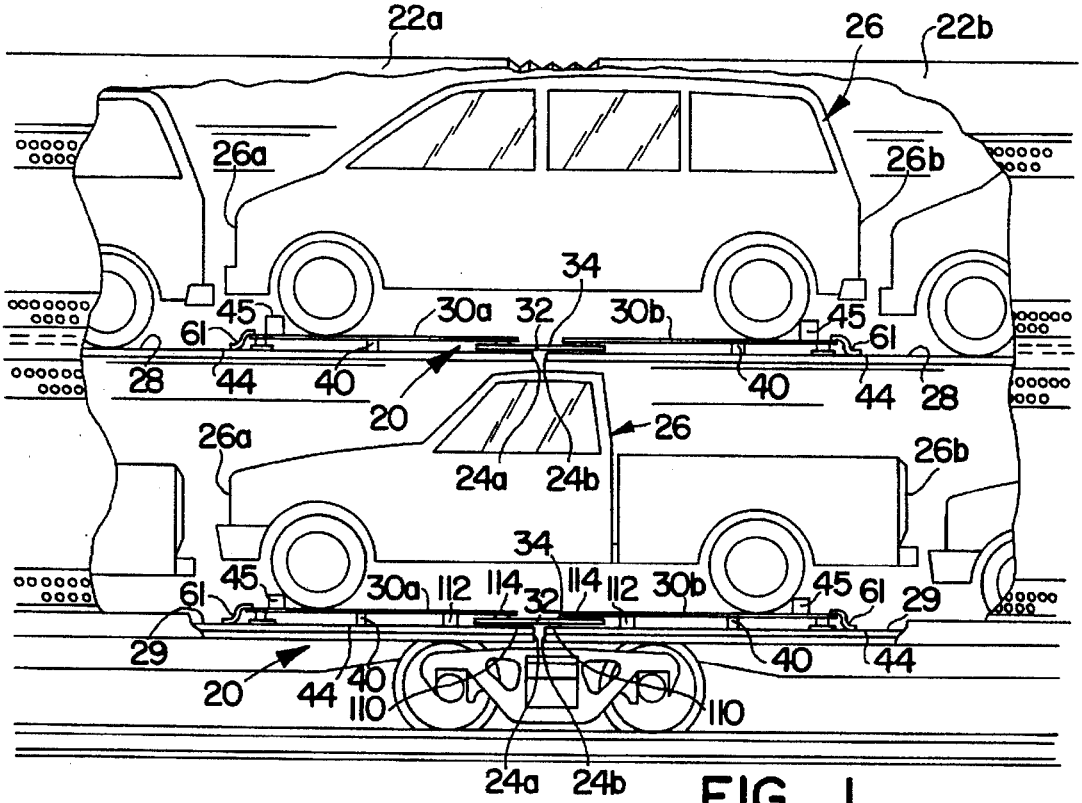
FIG. 1 is a cutaway, side elevational view of a pair of pivotably interconnected bi-level units of a vehicle-transporting railway car having a pivot plate assembly embodying various features of the present invention, with vehicles supported on the assembly straddling the articulation between the interconnected railway car units.
Figure 2:
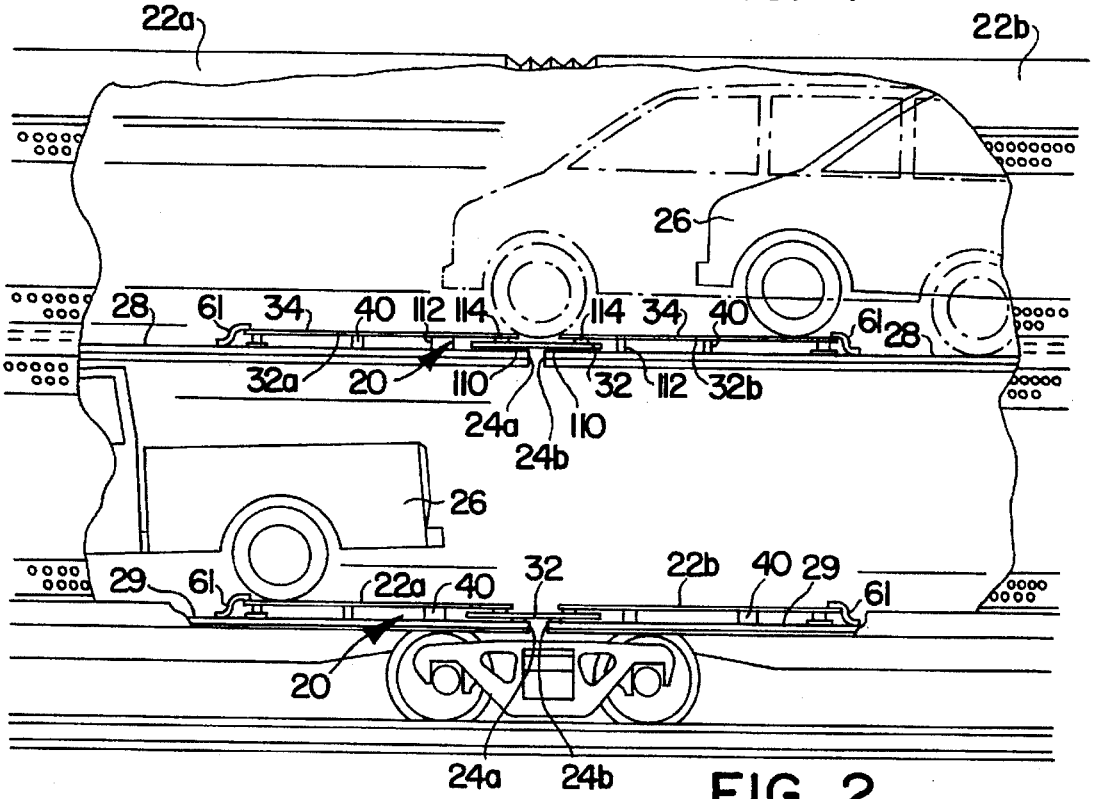
FIG. 2 is a cutaway, side elevational view of the pair of pivotably interconnected bi-level units of a vehicle-transporting railway car of FIG. 1 having the pivot plate assembly, and illustrating the rolling transport of vehicles across the pivot plate assembly from one unit of the railway car to another.
Figure 3:
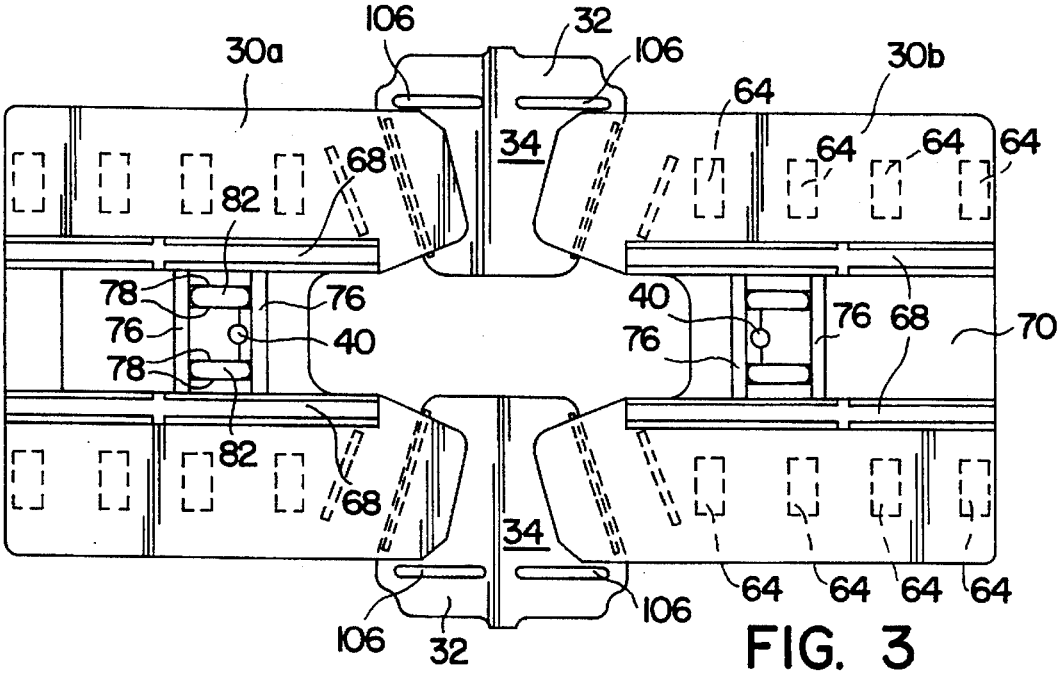
FIG. 3 is a plan view of the pivot plate assembly of FIG. 1, shown without the railway car units.
Figure 4:
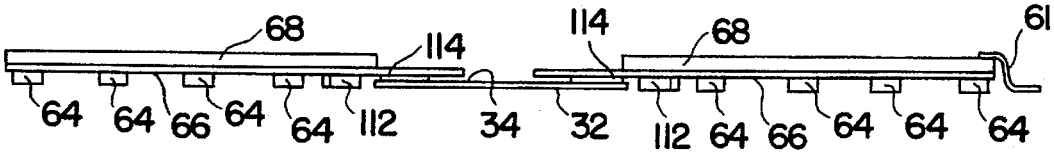
FIG. 4 is a side elevational view of the pivot plate assembly of FIG. 1.

A pivot plate assembly embodying various features of the present invention is illustrated in FIGS. 1–6 and referred to generally by reference numeral 20. With initial reference to FIGS. 1 and 2, the pivot plate assembly 20 is for use in spanning a pair of pivotably interconnected units 22*a* and 22*b* of a vehicle-transporting railway car at their pivotably interconnected ends 24*a* and 24*b* to stably support a vehicle 26 having a front portion 26*a* and a rear portion 26*b* straddling the articulation during transport as shown in FIG. 1. The pivot plate assembly 20 also allows rolling transport of vehicles 26 over the gap between the pivotably interconnected ends 24*a* and 24*b* of the railway car units 22*a* and 22*b* for rolling loading and unloading of vehicles between the units 22*a* and 22*b* of the railway car.

In the illustrated embodiment, the railway car units 22*a* and 22*b* are bi-level railway car units having a first, upper level 28 and a second, lower level 29 with respective pivot plate assemblies 20 spanning both the upper and lower levels 28 and 29. However, as will become apparent as the description of the invention proceeds, the pivot plate assembly 20 of the present invention lends itself to use with a wide variety of different railway cars including, for example, single level railway cars and triple level railway cars, and the invention is not limited to the illustrated bi-level railway cars. Also, the pivot plate assembly may be used in articulated railway cars of a wide variety of lengths, including, but not limited to, lengths of 122 feet, 140 feet and 156 feet. The term "articulated railway car" as used herein refers to both a pair of permanently-connected railway car units having common trucks, and also to a series of separably interconnected railway cars having respective trucks. Also, as will be apparent as the description of the preferred modes of the invention proceeds, the pivot plate assemblies of the present invention lend themselves to applications in which the relative movement between two adjacent railway car units is limited to pivotal movement as well as applications in which the relative movement between two adjacent railway car units may be both pivotal and longitudinal.

Figure 5:
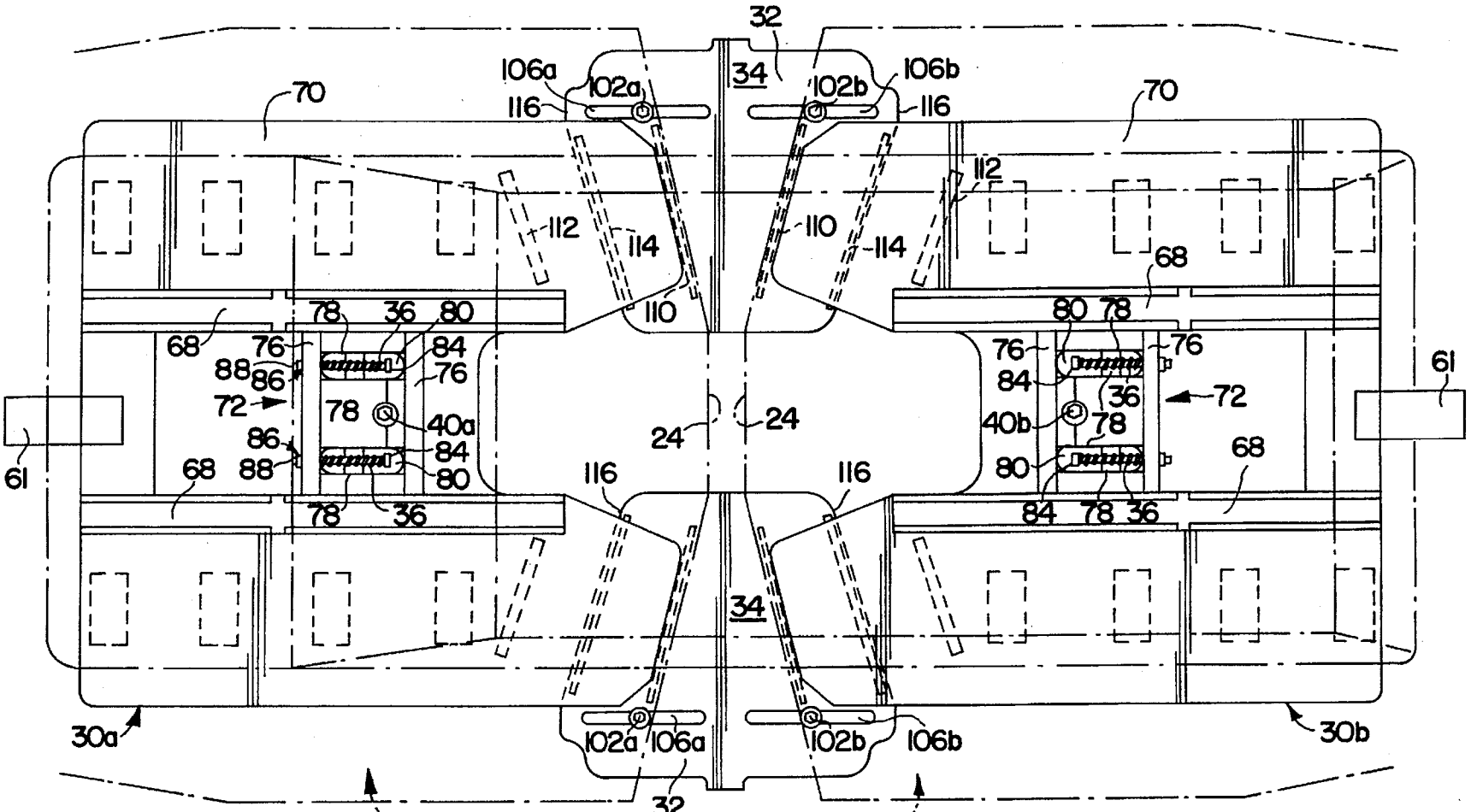
FIG. 5 is a plan view of the pivot plate assembly of FIG. 3, shown operatively connected to a pair of collinear, pivotably interconnected units of a railway car, portions of which are indicated by broken lines.
Figure 6:
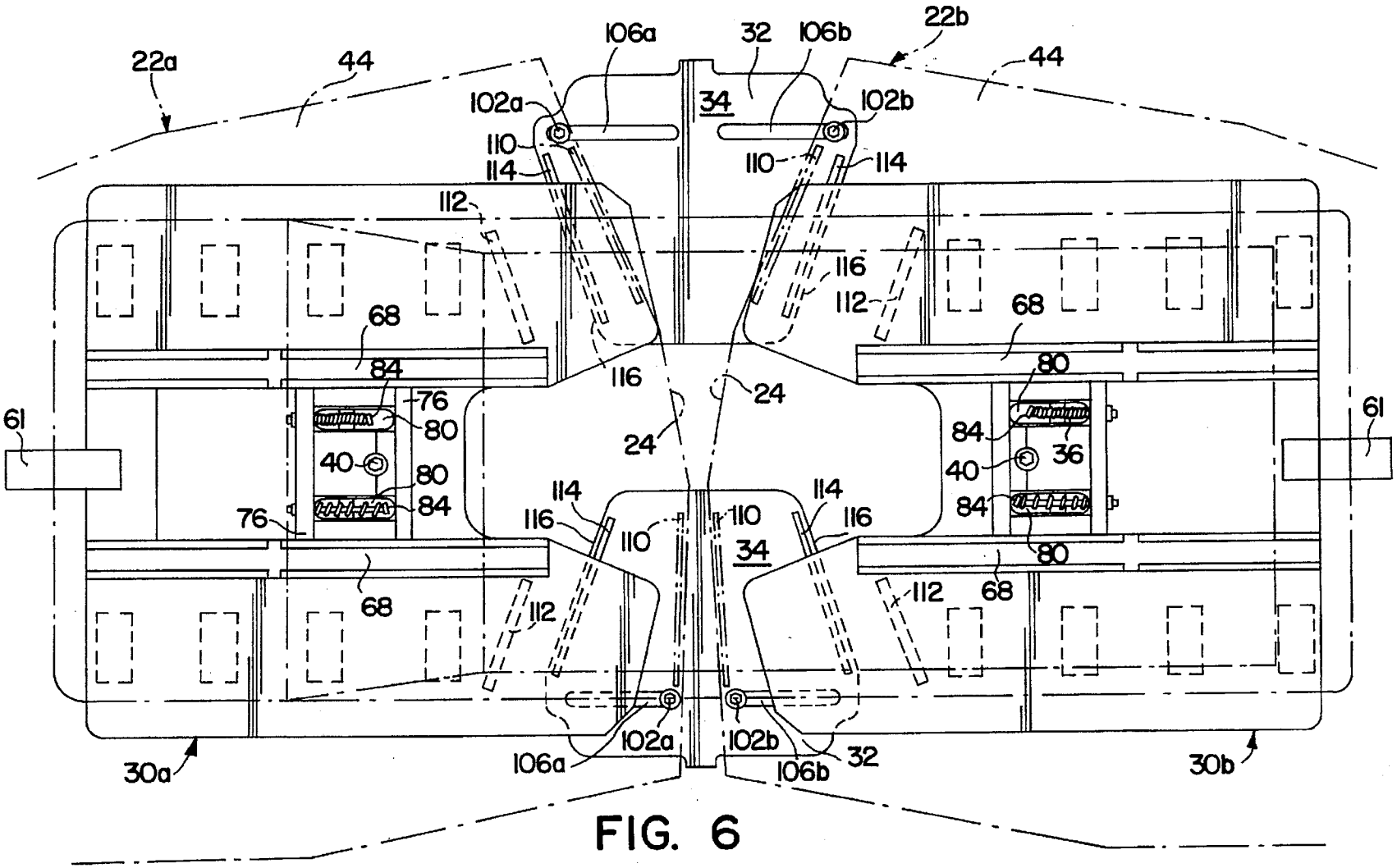
FIG. 6 is a plan view of the pivot plate assembly of FIG. 5, shown operatively connected to a pair of pivotably interconnected units of a railway car which are angled with respect to one another, portions of the railway car units being indicated by broken lines.
Figure 7:
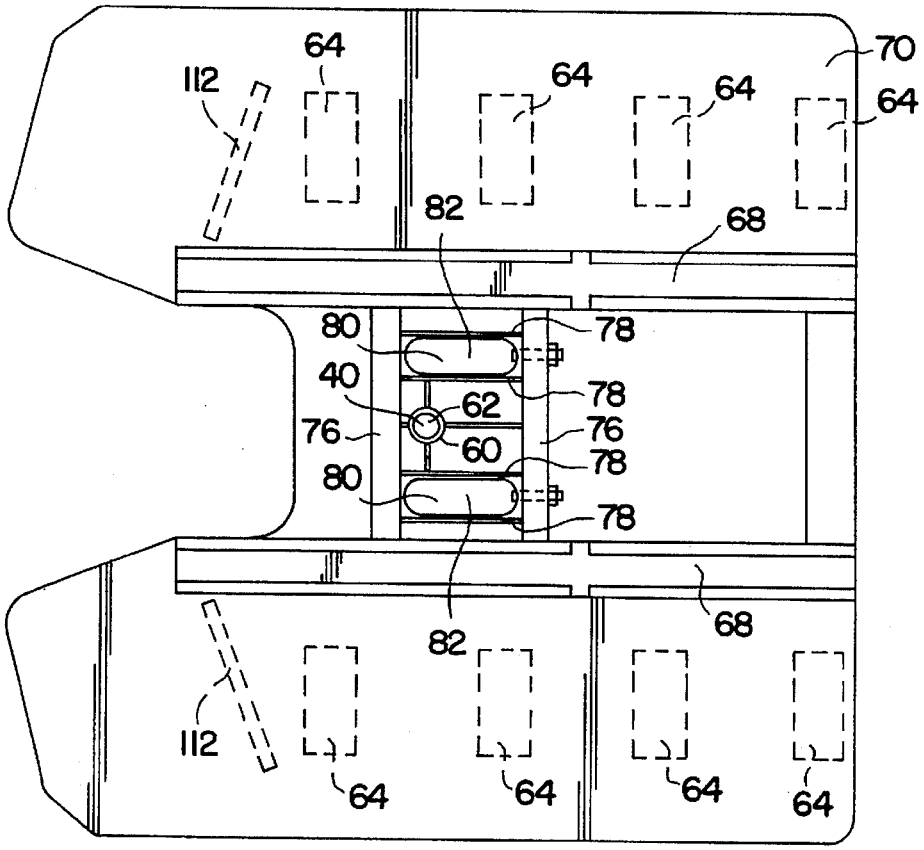
FIG. 7 is a plan view of one of the platforms of the pivot plate assembly of FIG. 3.

The illustrated pivot plate assembly 20 comprises a first platform 30*a* pivotably engaged to a first railway car unit 22*a* adjacent the end 24*a* thereof which is adjoined to the second railway car unit 22*b*. This allows pivotal movement of the first platform 30*a* between a straightened position in which the first platform 30*a* extends generally parallel to the first railway car unit 22*a* (see FIG. 5) and an angled position in which the first platform 30*a* extends at an angle with respect to the first railway car unit 22*a* (see FIG. 6). Likewise, a second platform 30*b* is pivotably engaged to the second railway car unit 22*b* adjacent the end 24*b* thereof adjoined to the first car unit 22*a* to allow pivotal movement of the second platform 30*b* between a straightened position in which the second platform 30*b* extends generally parallel to the second car unit 22*b* (FIG. 5), and an angled position in which the second platform 30*b* extends at an angle with respect to the second car unit 22*b* (FIG. 6). The first and second pivotal platforms 30*a* and 30*b* are referred to generally herein by reference numeral 30.

The front end portion 26*a* of the vehicle 26 straddling the articulation is supportable upon and securely engageable with the first platform 30*a*, and the rear end portion 26*b* of the vehicle 26 straddling the articulation is supportable upon the second platform 30*b*. A wide variety of means for constraining the vehicles relative to the platforms or car decks are well known. For instance, a wide variety of different chocks or other wheel-engaging devices may be employed. Chocks which are known in the art include chocks having chains or straps extending over the vehicle tires, chocks having bars engaging the vehicle tires, and chocks which are engageable with a grating, mesh or perforated floor on which the vehicle tires are supported. Alternatively, or in addition to the chocks, the vehicle frame itself may be attached to the platforms or car deck through use of ratchets and chains, or the like.

The engagement of the front and rear portions 26*a* and 26*b* of the vehicle 26 with respective first and second pivotal platforms 30*a* and 30*b* maintains the first and second platforms in substantially collinear relation to one another during pivotal movement of the first and second car units 22*a* and 22*b* with respect to one another between their straightened and angled positions (compare FIGS. 5 and 6) to stably support the vehicle on the platforms 30*a* and 30*b* and straddling the articulation between the units during transport. That is, as the railway car units 22*a* and 22*b* move angularly with respect to one another, such as when navigating a section of track with a varying radius of curvature, the vehicle 26 holds the pivotal platforms 30*a* and 30*b* substantially stationary with respect to the vehicle, with the railway car units 22*a* and 22*b* pivoting beneath their respective platforms 30*a* and 30*b*. Hence, the pivotal platforms 30*a* and 30*b* pivot on the respective railway car units 22*a* and 22*b* to which they are pivotally attached, but the pivotal platforms do not pivot with respect to the vehicle 26 supported on the platforms. Therefore, the pivotal platforms 30*a* and 30*b* remain substantially stationary with respect to the vehicle 26 to provide a stable supporting surface for the vehicle 26. Accordingly, the vehicle 26 may be transported while straddling the articulation between adjacent railway car units 22*a* and 22*b* without being subjected to any significant shifting which would otherwise be encountered without the use of the pivot plate assembly 20.

The resistance to free pivotal movement of the platforms, realized due to low frictional forces between the platforms and their respective railway car units, urges the platforms to pivot in the directions of their respective railway car units. The engagement of the vehicle to both the platforms prevents the platforms from pivoting significantly with respect to one another. With low friction pads disposed between the pivotal platforms and the car unit decks, as described below, the torque forces imparted to the vehicle are relatively small and the structural strength of the vehicles allows the vehicles to easily withstand the torque.

The pivot plate assembly 20 also provides stable support of vehicles 26 when transported with one pair of its wheels on the deck 44 of the railway car unit and the other pair of its wheels on the respective pivotal platform 30. With vehicles loaded onto a railway car unit in this arrangement, and one pair of wheels constrained on the platform 30 with chocks 45 and the other pair of wheels constrained on the car unit deck 44 with chocks 45, the pivotal platform 30 and the respective car deck 44 pivot together. Therefore, the supporting surface beneath the vehicle 26 remains substantially stationary with respect to the vehicle support thereon throughout pivotal movement of the railway car units. Accordingly, the pivot plate assembly 20 of the present invention greatly increases loading options and stably supports vehicles during transport whether the vehicles are completely supported on the pivotal platforms 30 and straddling a pair of articulated railway car units, or whether the vehicles are only partially supported on the pivotal platforms.

The pivot plate assembly 20 also preferably comprises bridge plates 32 extending between the first and second pivotal platforms 30*a* and 30*b* to allow rolling loading and unloading of vehicles between adjacent railway car units. That is, the bridge plates 32 span the two rail car units 22*a* and 22*b*. The first and second pivotal platforms 30*a* and 30*b* each overlap both of the bridge plates 32 so that the bridge plates 32 also span the pivotal platforms 30*a* and 30*b*, as seen in FIGS. 5 and 6. The pair of bridge plates 32 are preferably each slidably engaged with both the first and second railway car units 22*a* and 22*b*, as described below. The upper surfaces 34 of the bridge plates 32 provide supporting surfaces for rolling loading and unloading of vehicles over the articulation from one of the railway car units to the other. The bridge plates 32 remain in place during loading and unloading of vehicles, as well as during transport of the vehicles.

The pivot plate assembly 20 also preferably employs springs 36 to return the pivotal plates 30*a* and 30*b* to their straightened positions, substantially parallel to their respective railway car units 22*a* and 22*b*, following unloading of vehicles 26 from the pivotal platforms. The springs 36 extend between the pivot platforms 30*a* and 30*b* and their respective railway car units 22*a* and 22*b*. Hence, prior to loading the vehicles 26 onto the railway car units 22, the springs 36 will have returned the pivotal platforms 30*a* and 30*b* to their straightened positions, thereby eliminating the need for an operator to go through the railway cars and straighten out all of the pivotal platforms. This makes loading of vehicles onto the railway cars significantly faster and easier.

The general construction of the present invention having been set forth above, the preferred embodiments of the invention will now be described in greater detail.

Figure 14:
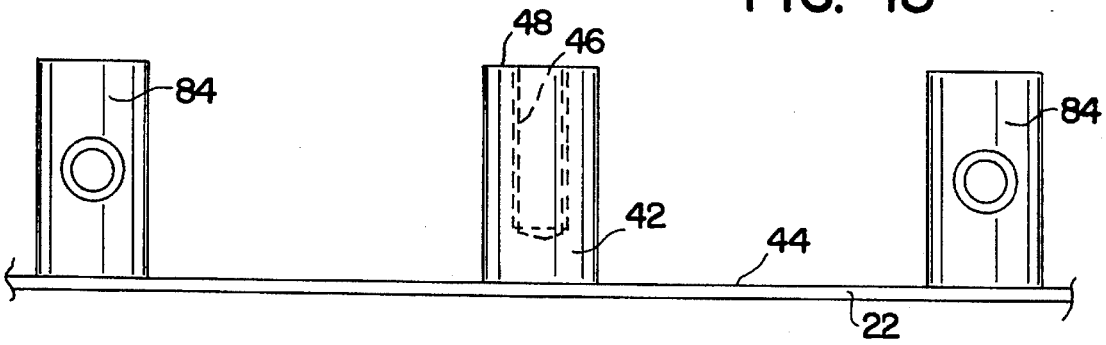
FIG. 14 is an end elevational view of a pivot pin and spring mounting blocks extending upwardly from a railway car unit deck.
Figure 9:
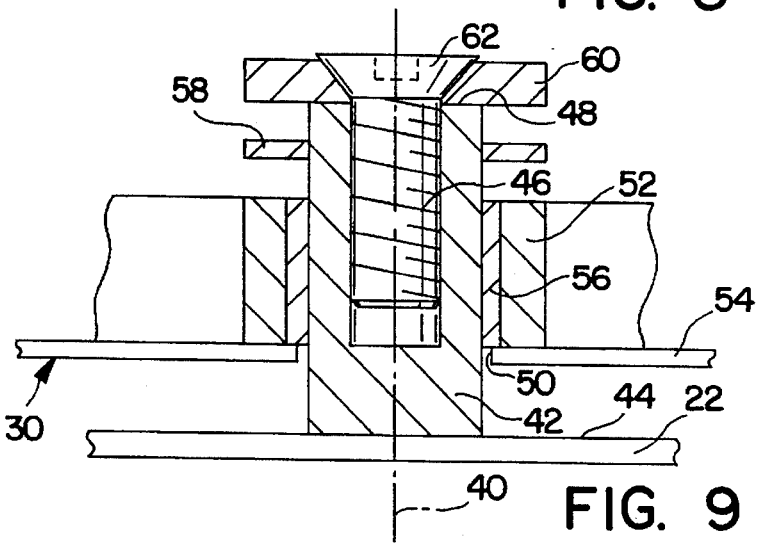
FIG. 9 is a side sectional view of the pivotal connection of a platform to a railway car unit.

The pivotal platforms 30*a* and 30*b* are pivotably connected to their respective railway car units 22*a* and 22*b*, at pivot axes 40*a* and 40*b*. With reference to FIGS. 9 and 14, circularly cylindrical pivot pins 42 extend upwardly from the decks 44 of the railway car units 22. A threaded bore 46 extends into each of the pivot pins 42 downwardly from their upper ends 48, as best shown in FIG. 14. With specific reference now to FIG. 9, the pivotal platforms 30*a* and 30*b* each have an aperture 50 with a short length of circularly cylindrical pipe 52 welded integrally to the pivotal platforms to extend upwardly from the upper, supporting surfaces 54 of the pivotal platforms 30*a* and 30*b* and centered about the aperture 50 in the pivotal platforms. The apertures 50 in the pivotal platform 30 are aligned with respective pivot pins 42 and the pivotal platforms 30*a* and 30*b* lowered onto the pivot pins 42 to the position shown in FIG. 9, in which the pivot pins 42 extends through respective apertures 50. A circularly cylindrical pivot pipe sleeve 56 of low friction polymeric material lines the interior of the pipe 52 and fits closely about the pivot pin 42 for low friction pivotal oscillation of the pivotal platform 30 about the pivot pin 42 with little play therebetween.

To prevent the pivotal platform 30 from rising too far upwardly and becoming disengaged from the pivot pin 42, a bolt and washer arrangement is employed at the upper end of the pivot pin 42 to hold down the pivotal platform 30. A pivot washer 60 is secured at the upper end 48 of the pivot pins 42 by a pivot pin bolt 62 screwed into the threaded bore 46 of the pivot pin 42. The pivot washer 60 prevents the pivotal platform 30 from raising off of the pivot pin 42, with the pivotal platform 30 being retained between the deck 44 of the railway car unit 22 at the lower end of the pivot pin 42 and the pivot washer 60 at the upper end 48 of the pivot pin 42. A wear washer 58 is disposed on the pivot pin 42 between the pivotal platform 30 and the pivot washer 60. The wear washer 58 reduces wear to the pivot washer 60. During normal operation of the pivot plate assembly 20, the pivotal platform 30 is spaced from both the car unit deck 44 and the pivot washer 60, as described below. To prevent the pivotal platforms 30 from raising upwardly when ratchets and chains are used to secure a vehicle, hold-down strips 61 are mounted to the car deck 44 and overlap the rear end portions of the pivotal platforms 30.

Each of the illustrated pivotal platforms 30*a* and 30*b* has a pair of parallel tie-down tracks 68 on its upper side 70 for engageably receiving chocks 45 to securely hold the vehicle loaded onto the pivotal platforms 30 in a substantially stationary position with respect to the pivotal platforms, as mentioned briefly above. The wheels of the vehicle 26 are supported on the pivotal platform 30 outwardly of the pair of tie down tracks 68 so that the wheels straddle the tie down tracks 68. The chocks 45 are secured in the tie down tracks 68 forward or forward and aft of the rear wheels of the vehicle 26, with a small space of approximately ¾ inch or less provided between the rear wheels and the chocks 45. As mentioned above, manifestly a wide variety of chock arrangements and systems are well known to those skilled in the art and the invention is not limited to the specific chock arrangements disclosed herein.

Alternatively, in place of the tie-down tracks 68, wheel guides may be provided at the location shown for the tie-down tracks to guide the inside edges of the vehicle tires.

Vehicles are loaded onto the pivotal platforms with the railway car units 22 on a track, and therefore track, and therefore substantially collinear with respect to one another as shown in FIG. 5. The vehicle 26 straddling the articulation between adjacent railway car units 22 has its front end portion 26*a* secured to a first pivotal platform 30*a*, and its rear end portion 26*b* secured to the second pivotal platform 30*b*. Thereby, the vehicle holds the first and second platforms 30*a* and 30*b* in the substantially collinear relation shown in FIGS. 3 and 5, with the platforms 30*a* and 30*b* each extending substantially parallel to their respective railway car units 22*a* and 22*b*.

During transport of the vehicle 26 while straddling the railway car units 22*a* and 22*b*, the vehicle maintains the platforms 30*a* and 30*b* in their collinear relation while the railway car units 22*a* and 22*b* navigate a turn and pivot with respect to one another, as shown in FIG. 6. The pivotal connection of the pivotal platforms 30*a* and 30*b* to their respective railway car units 22*a* and 22*b* allows the railway car units 22*a* and 22*b* to pivot with respect to the platforms 30, thereby allowing the platforms 30 to remain collinear as the railway car units pivot. Accordingly, regardless of the pivotal position of the railway car units 22*a* and 22*b* with respect to one another, the vehicle 26 maintains the pivotal platforms 30*a* and 30*b* in substantially collinear relation to one another. This is seen in comparing FIGS. 5 and 6 in which the angular relation between the railway car units 22*a* and 22*b* is changed, but the angular relation between the pivotal platforms 30*a* and 30*b* remains substantially constant. Accordingly, the pivotal platforms 30*a* and 30*b* provide a floor for supporting the vehicle 26, which floor remains stationary with respect to the vehicle supported thereupon so that the vehicle 26 straddling the railway car units 22*a* and 22*b* is not jostled around.

It is important that the pivotal platforms 30*a* and 30*b* be substantially parallel to their respective railway car units 22*a* and 22*b* during rolling loading of vehicles 26 across the pivotal platforms from one railway car unit to the next. Otherwise, the wheels of the vehicle being loaded may careen off the tie down tracks 68 of an angularly situated platform and direct the vehicle into contact with a wall of the railway car unit, which may result in damage to the vehicle. To assure that the pivotal platforms 30 are returned to their straightened positions substantially parallel to their respective railway car units 22 prior to loading vehicles 26 onto the platforms 30*a* and 30*b*, spring arrangements 72 are preferably employed. The spring arrangements 72 bias the respective pivotal platforms 30*a* and 30*b* to their straightened position with respect to their railway car units 22*a* and 22*b*. Hence, following unloading of a vehicle 26 from the pivotal platforms 30, the spring arrangement 72 returns the pivotal platforms 30 to their straightened positions. This eliminates the need for an operator to go through each of the railway car units and manually pivot each pivotal platform 30 to its straightened position prior to loading of vehicles. Also, as a vehicle rolls off of a pivotal platform 30 during loading of vehicles from one railway car unit to the next, it may knock one or more of the platforms 30 to an angled position. The spring arrangement 72 serves to automatically return the pivotal platform to a straightened position so that the next vehicle loaded onto the platform will encounter a straightened platform rather than an angled platform.

Figure 13:
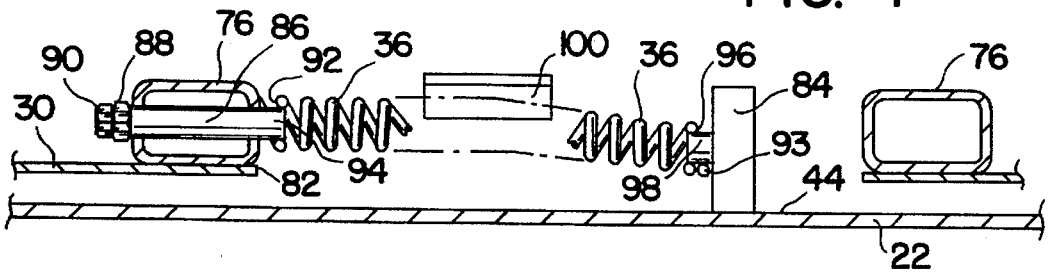
FIG. 13 is a partial, enlarged side elevational view of a biasing spring arrangement for returning the pivotal platforms to their straightened positions.
Figure 10:
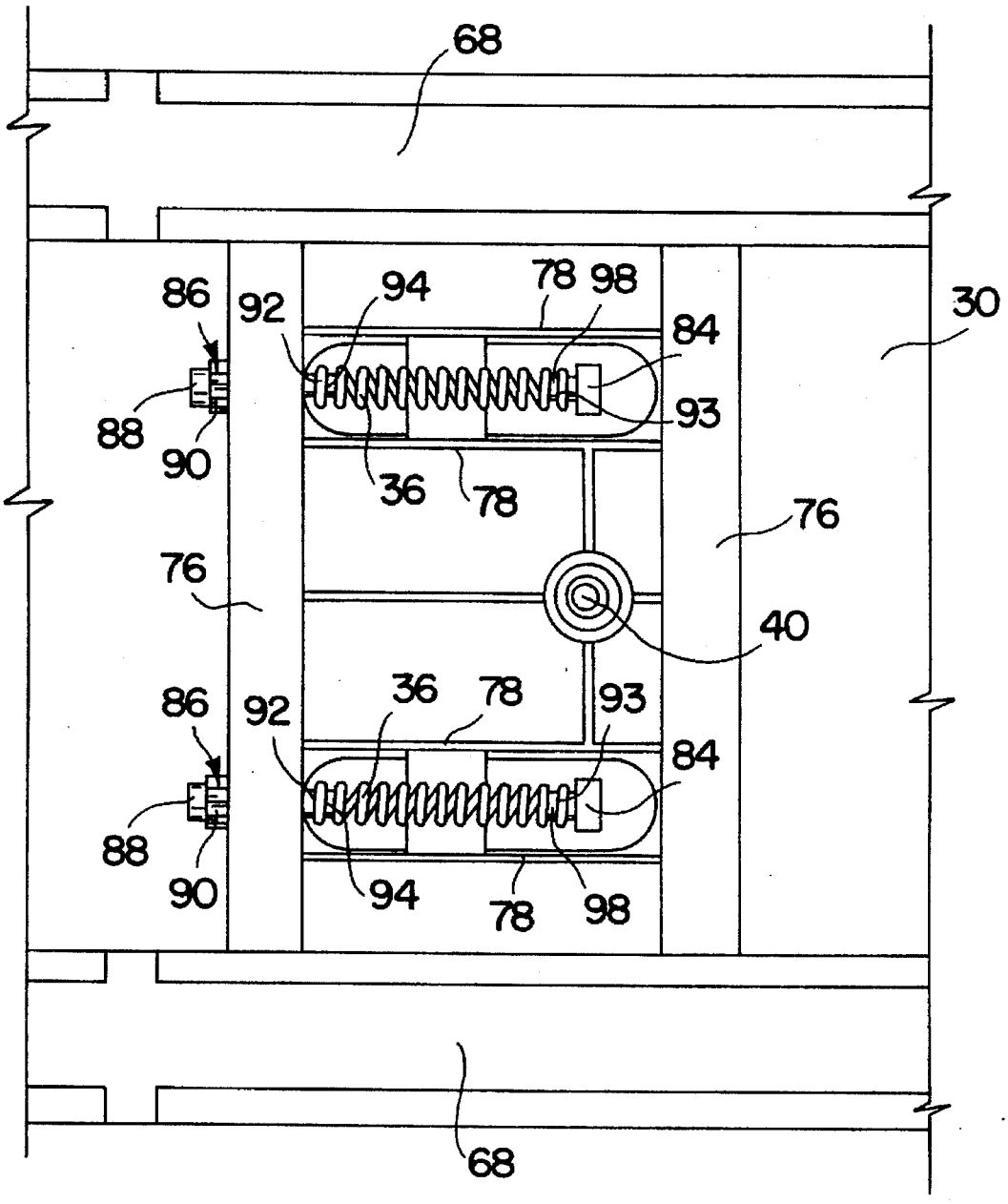
FIG. 10 is a partial plan view of the spring arrangement of the platforms of FIG. 3.

The illustrated spring arrangement 72 comprises springs 36 extending between the pivotal platform 30 and the deck 44 of the railway car unit 22 as illustrated in FIGS. 10 and 13. More specifically, a pair of springs 36 are disposed on either side of the pivot axes 40*a* and 40*b* of the pivotal platforms 30*a* and 30*b* to return the pivotal platforms 30*a* and 30*b* to their straightened positions.

With reference to FIGS. 10 and 13, a pair of struts 76 of rectangular tubing span the chock-engaging tie down tracks 68, extending generally perpendicularly to the tie down tracks 68. Two pair of spring side plates 78 span the pair of struts 76, with one pair of spring side plates 78 disposed on either side of the pivot axis 40. Each pair of spring side plates 78 defines a respective spring receiving channel 80 in the region between the pair of plates 78. The pivotal platforms 30 have apertures 82 (see FIG. 3) at the channels 80 which receive respective spring engaging blocks 84 extending upwardly from the deck 44 of the railway car units 22. That is, with reference also to FIGS. 10 and 13, each railway car unit 22 has a pair of spring engaging blocks 84 extending upwardly from its deck 44 which extend upwardly through the aperture 82 in the pivotal platform 30 and into the spring receiving channel 80, intermediate of the respective pair of struts 76. A full threaded spring tensioning bolt 86 extends through the outwardly situated strut 76, with a nut 88 threadably engaged with the bolt 86 adjacent the head 90 of the bolt 86 and between the bolt head 90 and the strut 76.

A compression spring 36 has a first end 92 attached to the leading end portion 94 of the bolt 86 which projects through the strut 76. The second, opposite end 93 of the compression spring 36 is attached to a short stub 98 of the spring engaging block 84. Accordingly, the compression spring exerts a compression force pushing the strut 76 of the pivotal platform 30 and the spring engaging block 84 of the railway car 22 away from one another. With reference to the pivotal platform 30*a* of FIG. 5, as viewed in FIG. 5 the spring 36 nearer the bottom of the page exerts a force urging the pivotal platform 30*a* in a clockwise direction, and the spring 36 nearer the top of the page in FIG. 5 exerts a force urging the pivotal platform 30*b* in a counter-clockwise direction. The spring compression force is selectively variable by turning the nut 88. By adjusting the compression in the pair of springs 36, one on either side of the pivot axis 40, to approximately the same tension force, the springs counteract one another to hold the pivotal platform 30*a* in the straightened position shown in FIG. 5. The same spring arrangement 72 is employed for the pivotal platform 30*b* as well, and serves to maintain pivotal platform 30*b* in the straightened position of FIG. 5.

With no vehicle loaded on the pivotal platforms, if either or both of the pivotal platforms 30*a* and 30*b* are knocked out of their straightened position to an angled position, the springs 36 return the pivotal platforms to their straightened positions. For instance, with reference to the view of FIG. 5, if the pivotal platform 30*a* is pivoted clockwise from its straightened position shown in FIG. 5, to the angled position shown in FIG. 6, the spring engaging block 84 in the channel 82 nearer the lower end of the page as viewed in FIG. 5 is moved toward the right end of the channel 82 nearer the upper end of the page, and the spring engaging block 84 in the channel 82 nearer the upper end of the page is moved toward the left end of its channel 82. Hence, the compression in the spring 36 nearer the lower end of the page in FIG. 5 is decreased and the compression in the spring 36 nearer the upper end of the page in FIG. 5 is increased, whereby the significantly greater compression in the spring 36 nearer the upper end of the page in FIG. 5 relative to the tension in the spring 36 nearer the lower end of the page in FIG. 5 causes the pivotal platform 30 to pivot back counter-clockwise toward its straightened position. The momentum of the pivotal platform 30*a* in its return may cause the platform to pivot beyond its straightened position to a position slightly counter-clockwise from its straightened position. The difference in spring compressions will then urge the pivotal platform in a clockwise direction. The frictional forces encountered in pivotal movement of the pivotal platform 30 dampen the extent of oscillatory pivotal movement of the pivotal platform 30*a* so that the platform 30*a* comes rapidly to rest at its straightened position. A stiffener 100 is preferably provided to span the spring side plates 78 to provide increased structural support to the spring side plates 78 and also to prevent the spring 36 from bulging outwardly of its respective spring receiving channel 80.

As mentioned briefly above, to allow for rolling transport of vehicles 26 between the pivotal platforms 30*a* and 30*b*, and hence, allow rolling loading and unloading of vehicles 26 across the articulation between pivotably interconnected railway car units 22*a* and 22*b*, the pivot plate assembly 20 also preferably comprises bridge plates 32 extending between the first and second pivotal platforms 30*a* and 30*b*. The first and second pivotal platforms 30*a* and 30*b* each overlap both of the bridge plates 32 so that the bridge plates 32 span the pivotal platforms 30*a* and 30*b*, as seen in FIGS. 5 and 6. The upper surfaces 34 of the bridge plates 32 provide supporting surfaces for rolling loading and unloading of vehicles 26 over the articulation from one of the railway cars to the other.

Figure 8:
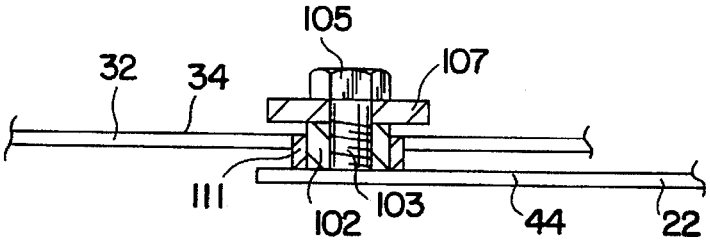
FIG. 8 is a side sectional view of the slidable engagement of a stud extending upwardly from a railway car unit deck with the slot in a bridge plate.

With reference to FIGS. 5, 6 and 8, circularly cylindrical studs 102*a* and 102*b* extend upwardly from the decks 44 of respective railway car units 22*a* and 22*b* and are received in respective slots 106*a* and 106*b* of the bridge plates 32. More particularly, with specific reference to FIG. 8, railway car unit 22*a* has a pair of studs 102*a* and railway car unit 22*b* has a pair of studs 102*b*, each having a respective threaded bore 103. A bolt 105 secures a retaining washer 107 at the upper end of each stud 102 to prevent the bridge plates 32 from raising off of the studs 102*a* and 102*b*. A polymeric sleeve 111 lines the periphery of the studs 102*a* and 102*b* for low friction sliding of the studs 102*a* and 102*b* within their respective slots 106*a* and 106*b*.

With reference to FIG. 5, the studs 102*a* and 102*b* at the lower end of the drawing are received in respective collinear slots 106*a* and 106*b* of the bridge plate 32 at the lower end of the drawing to allow for sliding of the studs 102 within their respective slots 106 during pivotal movement of the railway cars. Likewise, the studs 102*a* and 102*b* at the upper end of the drawing are received in respective collinear slots 106 of the bridge plate 32 at the upper end of the drawing to allow for sliding of the studs 102 within their respective slots. Thereby, both of the bridge plates 32 are maintained overlapping both of the adjacent interconnected ends 24*a* and 24*b* of the railway car units 22*a* and 22*b*. The pivotal platforms 30*a* and 30*b* are proportioned to extend to near the adjacent interconnected ends 24*a* and 24*b* of their respective railway car units 22*a* and 22*b*, and the bridge plates 32 are proportioned to extend beyond both of the adjacent ends 24*a* and 24*b* of the railway car units so that the bridge plates 32 span the pivotal platforms 30*a* and 30*b*, with the pivotal platforms 30*a* and 30*b* being maintained in overlapping relation with the bridge plates 32 throughout pivotal movement of the railway car units 22.

Figure 11:
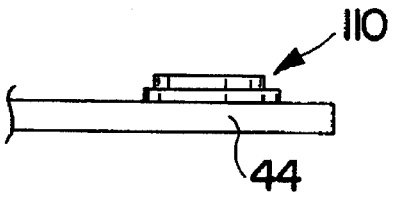
FIG. 11 is a partial side elevational view of a first spacer bar extending upwardly from a railway car deck.
Figure 12:
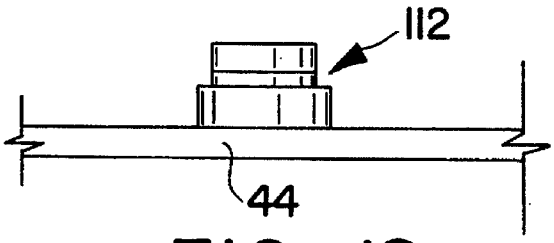
FIG. 12 is a partial side elevational view of a second spacer bar extending upwardly from a railway car deck.

To maintain proper vertical spacing between the car deck 44, bridge plates 32 and pivotal platforms 30, and reduce friction associated with sliding motion between these components, each of the railway car units 22*a* and 22*b* has a first pair of wear bars 110 mounted to the car deck 44 extending upwardly from the car deck 44 adjacent the end 24 of the car deck 44 for being disposed between the car deck 44 and the bridge plates 32. A second pair of relatively thicker wear bars 112 are also mounted to extend upwardly from the car deck 44 at a location beyond the extent of movement of the bridge plate 32. The wear bars 112 are thus disposed between the car deck 44 and the pivotal platforms 30, and spaced sufficiently from the bridge plates 32 that the bridge plates 32 do not slide between the wear bars 112 and the pivotal platforms 30. Thereby, the wear bars 112 maintain proper spacing and low friction sliding between the car deck 44 and the pivotal platforms 30*a* and 30*b*. The wear bars 110 and 112 are shown in greater detail in FIGS. 11 and 12, respectively. Finally, a third pair of wear bars 114 are mounted to the upper surface 34 of the bridge plates 32 adjacent the edges 116 of the bridge plates so as to be disposed between the bridge plates 32 and the pivotal platforms 30*a* and 30*b*. Alternatively, the plates and platforms may be made of a polymeric material which would not require a third pair of wear bars between the bridge plates and the pivotal platforms. Thereby, the series of wear bars 110, 112 and 114 maintain proper spacing and allow relatively low friction sliding between the car deck 44, bridge plates 32 and pivotal platforms 30. One material which has been found to be well suited for use as the material for the wear bars is a material sold under the tradename NYLATRON. Manifestly, a wide variety of other materials may be employed.

In typical operation, a series of empty, pivotably interconnected railway cars, each having a pair of pivotably interconnected railway car units 22, are brought to a vehicle loading zone. The length of track at the vehicle loading zone is generally straight, so that the railway car units extend collinearly. Pivot plate assemblies are provided on each deck level on either side of the articulation joint that connects two units together. A pivot plate assembly 20 is provided between each pair of pivotably interconnected railway car units 22. The spring arrangements 72 of the pivot plate assemblies 20 orient each of the pivotal platforms 30*a* and 30*b* to their straightened positions, whereby the pivotal platforms 30 extend substantially collinearly with respect to one another and with respect to the railway car units 22. A ramp is attached to the rear end of the rear-most railway car unit 22. A vehicle 26 is rolled up the ramp and onto the rear-most railway car unit. The vehicle 26 is then rolled through the pivotably interconnected railway car units 22 to the front unit, with the pivotal platforms 30*a* and 30*b* and the bridge plates 32 of the pivot plate assembly disposed between interconnected car units 22 providing supporting surfaces to allow easy rolling of the vehicle from one unit to the next. A plurality of vehicles 26 are loaded onto the railway car units in this manner, and loaded end to end from the front of the front-most unit 22. The vehicles 26 are each secured in their respective positions. After the front unit 22 has been loaded with vehicles 26 so that there is no longer sufficient room to load another full vehicle, the next loaded vehicle 26 may be loaded onto the pivotal plate assembly 20 between the front unit 22 and the next adjacent unit 22 to span the pair of adjacent railway car units 22. The vehicle 26 is then secured to both the pivotal platforms 30*a* and 30*b* of the pivot plate assembly 20. Alternatively, a vehicle 26 may have only a front end or rear end portion 26*a* or 26*b* supported on the pivotal platforms 30, with the other end of the vehicle 26 supported on the car deck 44.

Thereafter another vehicle 26 is loaded and rolled to a position adjacent the rear end portion 26*b* of the vehicle 26 straddling the articulation between the first railway car unit 22 and the next adjacent railway car unit 22. Vehicles 26 are loaded and rolled from one railway car unit 22 to the next in this manner, and secured in their respective end-to-end positions, including on the pivotal platforms 30 between interconnected units 22. Thereby, effective storage space is maximized.

During transport of the vehicles 26, both the vehicles supported on the pivot plate assembles 20 and those disposed between the pivot plate assemblies 20 are stably supported as described above, with the railway car units 22 pivoting beneath the pivotal platforms 30.

Vehicle unloading is similar to vehicle loading as describe above. The rear-most vehicle 26 is unloaded first, with adjacent vehicles unloaded consecutively thereafter. As the vehicles 26 are unloaded from the pivot plate assemblies 20, the spring arrangements 72 return the pivotal platforms 30*a* and 30*b* to their straightened positions. Hence, the next vehicle rolled over the pivot plate assembly 20 encounters the pivotal platforms 30*a* and 30*b* in their straightened positions.

It will be appreciated that loading, transport, and unloading of vehicles 26 across the gaps between adjacent railway car units 22 is significantly improved with the pivot plate assembly 20 of the present invention.

Figure 15:
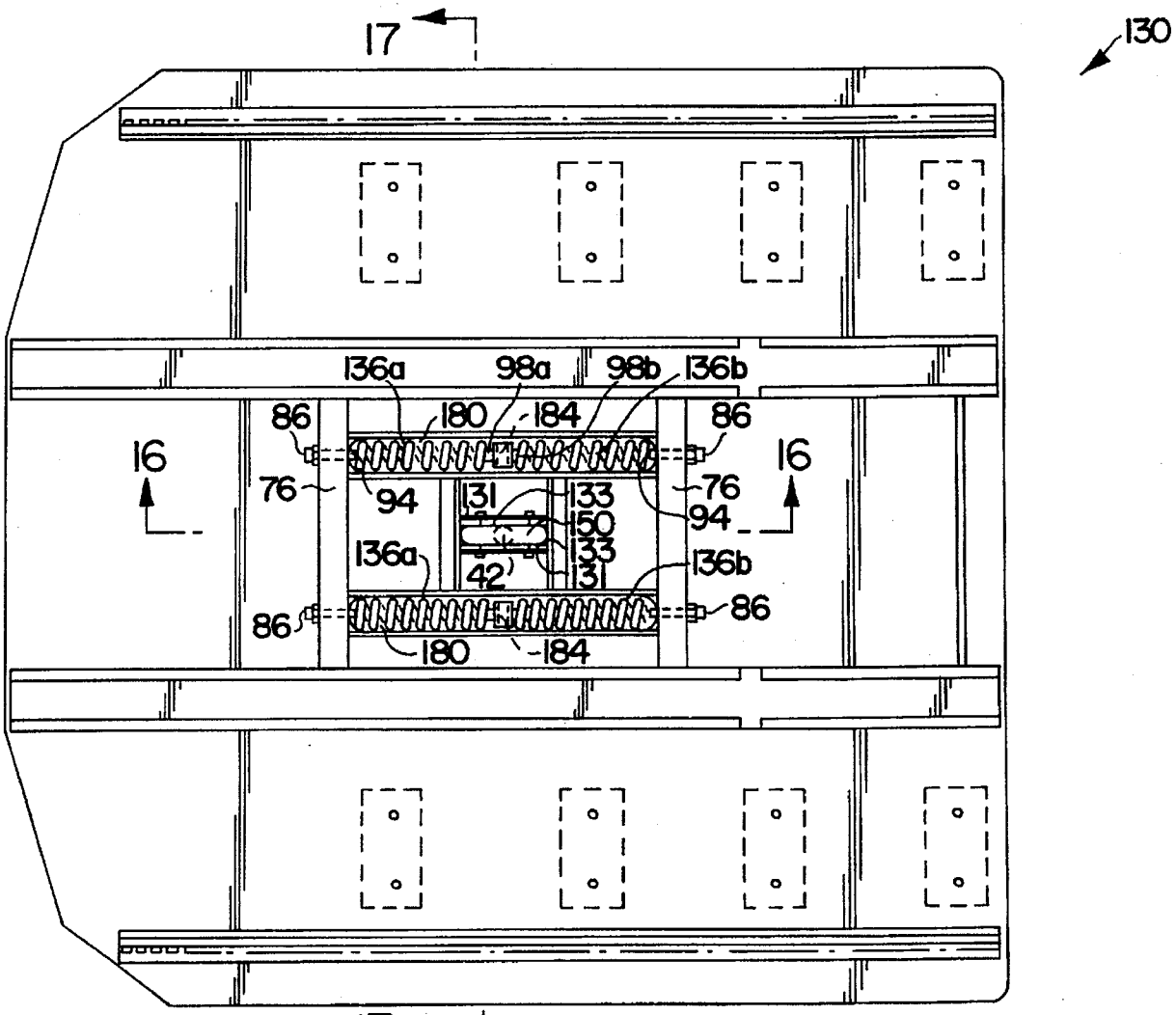
FIG. 15 is a plan view of a second pivot plate assembly embodying various features of the present invention.
Figure 16:
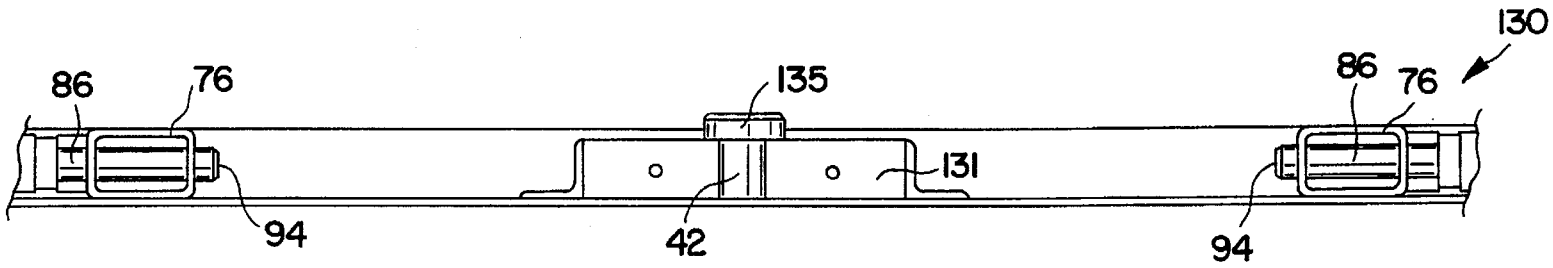
FIG. 16 is a sectional view taken through line 16—16 of the pivot plate assembly of FIG. 15.
Figure 17:
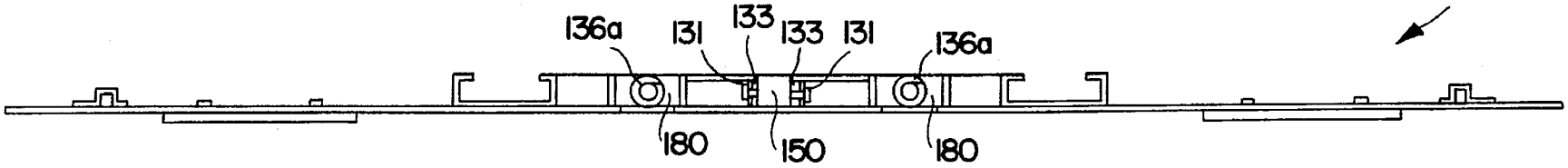
FIG. 17 is a sectional view taken through line 17—17 of FIG. 15.

Another pivotal platform 130 embodying various features of the present invention is illustrated in FIGS. 15–17. The illustrated pivotal platform 130 allows for significant longitudinal displacement of the pivotal platforms 130 with respect to their respective railway car units 22, and is therefore particularly useful for applications in which the opposing ends 24 of adjacent railway car units 22 move longitudinally with respect to one another, in addition to pivotal movement. Hence, the pivotal platform 130 is well suited for use in a pivot plate assembly for spanning the upper level decks 144 of interconnected railway car units 22 which typically move longitudinally with respect to one another significant amounts during transport, particularly when navigating a longitudinal curve or hill.

The pivot plate assembly formed with the pivotal platforms 130 is similar to the pivot plate assembly 20 formed with the pivotal platforms 30 described above, with the pivot plate assembly 120 having a spring arrangement and pivoting arrangement which differ considerably from those of the pivot plate assembly 20 described above. As best seen in FIG. 15, the pivotal platform 130 has an elongated, longitudinally extending aperture 150 through which the pivot pin 42 extends. The elongated aperture 150 allows for longitudinal sliding movement of the pivotal platform 130 with respect to its respective car deck 44 in addition to rotation of the pivotal platform 130 about the pivot pin 42. A pair of attachment bars 131 extend the length of the elongated aperture 150 on either side thereof, and a pair of wear bars 133 line the interior sides of attachment bars 131 for low friction pivotal and longitudinal oscillation of the pivot pin 42 within the elongated aperture 150. With reference to the sectional view of FIG. 16, a cap plate 135 is mounted to the top of the pivot pin 42 to prevent the pivotal platform 130 from raising off of the pivot pin 42.

The pair of spring-receiving channels 180 on either side of the pivot pin 42 are elongated and the pair of spring-engaging blocks 184 extending upwardly from the car deck 44 are received in respective elongated apertures 82. The spring-engaging blocks 184 are disposed at approximately the mid-span of the elongated apertures 180 when the pivotal platforms 130 are aligned with their respective railway car units 22. The spring-engaging blocks 184 have a pair of spring-engaging stubs 98*a* and 98*b* extending from either side of the blocks 184. The struts 76 each have a pair Of bolt-receiving apertures, so that bolts 86 extend into the spring-receiving channels 180 at the opposite ends of the channels 180. Each of the spring-receiving channels 180 receives two separate springs. A first spring 136*a* extends between the leading end portion 94 of the bolt 86 which projects through the strut 76 and the stub 98*a*, and a second spring 136*b* extends between the leading end portion 94 of the other bolt 86 which projects through the other strut 76 and the short stub 98*b* of the spring engaging block 84.

Upon longitudinal displacement of the pivotal platform 130 with respect to its railway car unit 22, the pivot pin 42 slides longitudinally within the elongated aperture 150, and the spring-engaging blocks 184 slide longitudinally within their respective spring-receiving channels 180 to accommodate the longitudinal displacement. The pivotal platforms 130 are pivotable about their respective pivot pins 42 regardless of the longitudinal position of the pivot pin 42 and spring-engaging blocks 184 within their respective slots 150 and 180. The springs 136*a* and 136*b* return the pivotal platforms 130 into alignment with their respective railway car units 22 in the manner discussed above with regard to the pivotal platforms 30.

Figure 18:
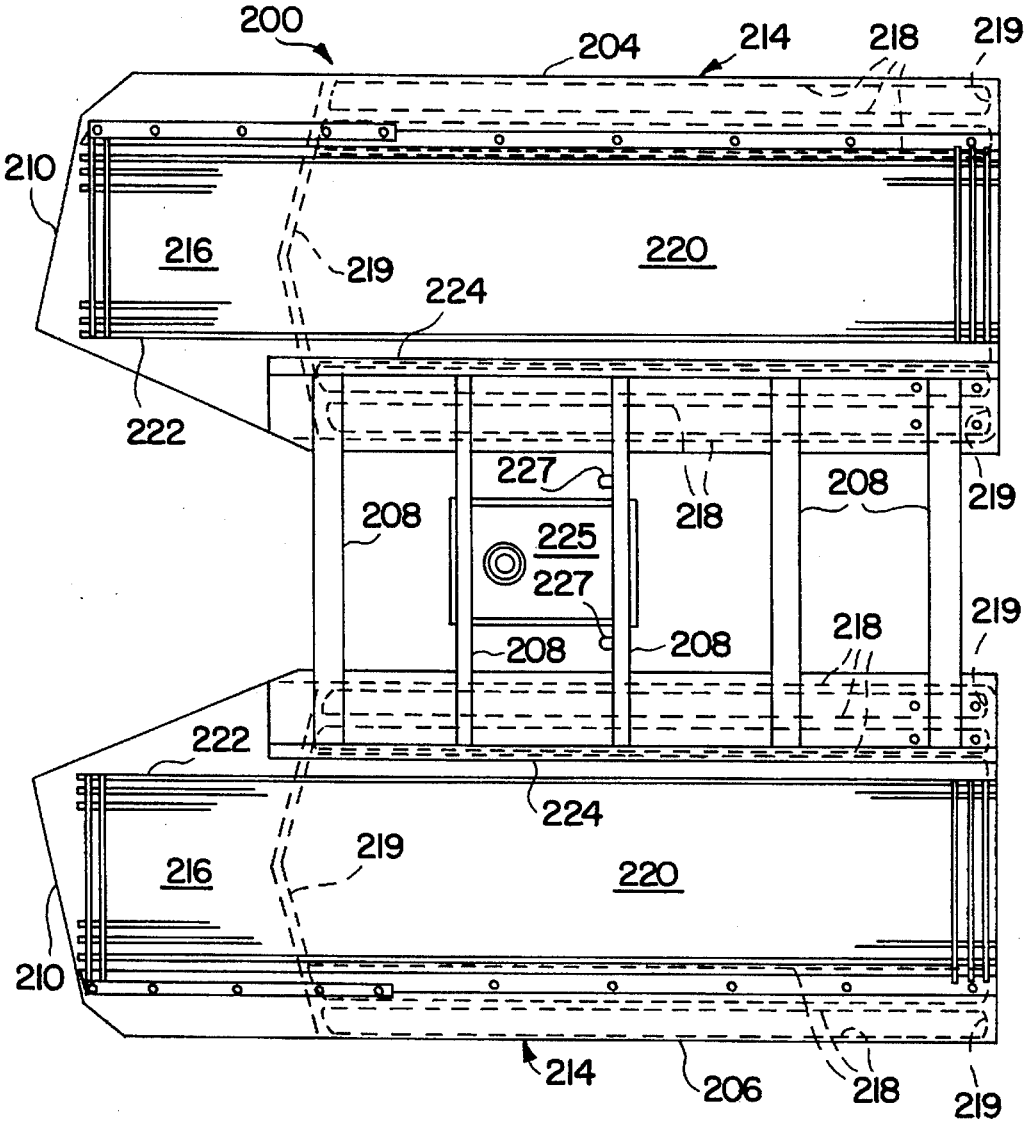
FIG. 18 is a plan view of a platform in accordance with an alternative embodiment of the invention.
Figure 19:
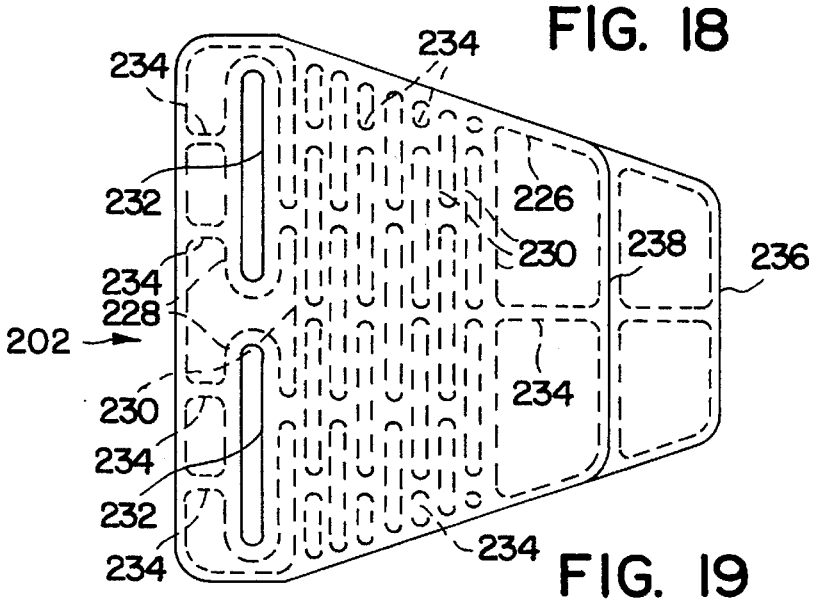
FIG. 19 is a plan view of a bridge plate in accordance with an alternative embodiment of the invention.

FIGS. 18 and 19 respectively illustrate a pivot plate assembly 200 and a bridge plate 202, which may be employed in combination with one another as an alternative to the pivot plate assembly and bridge plate described above. The pivot plate assembly 200 comprises first and second platforms 204 and 206 which are joined by transverse floor supports 208. Each platform 204 or 206 and bridge plate 202 is preferably molded as an integral unit from a lightweight, high strength, durable polymeric material. Examples of suitable materials include METTON, available from Metton of America, and TELENE, available from B. F. Goodrich. Each of the platforms and bridge plates has a ribbed construction to provide strength, rigidity, and light weight. Each of the illustrated platforms has an angled end portion 210 so that the platform ends are generally aligned with the adjacent end edges of the car deck.

Each platform preferably comprises a base portion 214 for engaging the deck, and an undercut portion 216 which in use overlaps an associated bridge plate 202. To provide for a substantially level, horizontal top surface for the platform, the base portion 214 of each platform is thicker than the undercut portion 216. The difference in thickness is made up by the bridge plate 202 under the undercut portion 216.

In the illustrated embodiment, each platform has a group of ribs 218 extending longitudinally along each side of its bottom surface. The longitudinal ribs are connected by lateral or transverse ribs 219. Between the groups of ribs, the central portion 220 of the platform is preferably spaced from the deck floor to accommodate wear blocks mounted on the deck floor, such as those indicated at 64 in FIG. 3. The central portion 220 of the platform between the groups of longitudinal ribs is positioned to support the tires on one side of a vehicle. Overlying the central portion of each platform, a grating 222 or similar track may be provided for use in combination with a wheel chock.

Each of the platforms 204 and 206 in FIG. 18 has a longitudinal guide rail 224 extending along the inner edge of the central portion 220 of the platform. The guide rail functions to guide the tires of vehicles being driven through the car and to stiffen the platform. The guide rail 224 is preferably bolted or otherwise fastened to the platform. The transverse floor supports 208 which connect the platforms 204 and 206 are welded or otherwise fastened to the guide rails 224 to provide a rigid, high strength connection between the platforms. The floor supports 208 may be elongated metal members such as channel members or angle members, or a combination of such members. Two of the floor supports are connected to a center support 225. One of the transverse floor supports 208 has a pair of studs 227 disposed on a vertical face to engage the springs which bias the assembly toward a centered position as described above.

Each of the bridge plates 202 illustrated in FIG. 19 has a configuration generally similar to that of the bridge plates described above and illustrated in, e.g., FIGS. 5 and 6, having a tapered shape such that its longitudinal dimension decreases toward its inner end, i.e., toward the center of the car. Each bridge plate has an aligned pair of elongated longitudinal slots 232 for receiving a pair of studs or the like extending upward from the deck. The bridge plate 202 has a ribbed bottom surface, which includes a peripheral rib 226 extending about the outer edge of the bottom surface, reinforcing ribs 228 extending about the periphery of each of the longitudinal slots 232, and a plurality of longitudinal ribs 230 on its central portion, positioned to support the tire of a vehicle. Additional transverse ribs 234 connect the peripheral rib 226, reinforcing ribs 228, and longitudinal ribs 230 for improved strength and rigidity.

To accommodate variations in the dimensions of the maximum gaps between the car units at the respective upper and lower decks, the bridge plate may be manufactured in two different sizes, a larger size for the upper deck, and a smaller size for the lower deck. FIG. 19 illustrates the larger size, with the inner edge of the larger version of the bridge plate indicated at 236. The smaller version differs from the larger version with respect to the location of the inner edge of the smaller bridge plate, which is indicated at 238 in FIG. 19.

In use, the bottom surfaces of the undercut portions 216 of the platforms 204 and 206 may rest directly upon, and may be in sliding engagement with, the upper surfaces of the bridge plates 202. To reduce wear and friction, these surfaces, or at least the portions of these surfaces which engage each other, are preferably smooth. The upper surfaces of the platforms 204 and 206, however, may be textured or nonskid surfaces.

While the invention is described with reference to preferred embodiments, it will be understood to those skilled in the art that various changes may be made and modifications equivalents may be substituted for elements thereof without departing from the scope of the invention. For instance, while the description of the invention is with reference to a pivotal platform assembly spanning a pair of pivotably permanently-interconnected railway car units, it will be readily apparent that the pivot plate assembly of the present invention lends itself to use in spanning the articulation between each of a series of separate railway cars to allow rolling transport of vehicles from a rear-most car of a chain to the front-most car of the chain. Also, while the articulated car referred to herein has only a pair of units, it will be appreciated to those skilled in the art that articulated cars may have many units. Therefore, it is intended that the invention not be limited to the particular embodiments disclosed as the best mode contemplated for carrying out this invention, but that the invention will include all embodiments falling within the scope of the appended claims.

What is claimed is:

1. An articulated railway car for cost-effective shipment of automotive vehicles comprising adjoining first and second vehicle-transporting railway car units and a pivot plate assembly for spanning said adjoining first and second vehicle-transporting railway car units at their articulation to support a vehicle having a front portion and a rear portion stradding the articulation during transport in which the railway car units move between a straight position in which the railway car units are generally collinear with respect to one another, and a curved position in which the railway car units are angled with respect to one another, the first and second railway car units having respective longitudinal axes and car decks, and the pivot plate assembly comprising:

a first platform having a longitudinal axis and being pivotably engaged to the first railway car unit adjacent the end thereof adjoined to the second railway car unit, to allow pivotal movement of the first platform between a straightened position in which the longitudinal axis of the first platform aligns with the longitudinal axis of the first railway car unit and an angled position in which the longitudinal axis of the first platform extends at an angle with respect to the longitudinal axis of the first railway car unit;

a second platform having a longitudinal axis and being pivotably engaged to the second car adjacent the end thereof adjoined to the first railway car unit to allow pivotal movement of the second platform between a straightened position in which the longitudinal axis of the second platform aligns with the longitudinal axis of the second railway car unit, and an angled position in which the longitudinal axis of the second platform extends at an angle with respect to the longitudinal axis of the second railway car unit;

said first and second platforms each having means for engaging a respective one of the front and rear portions of the vehicle straddling the articulation; and the first and second platforms being maintainable in substantially collinear relation to one another by the vehicle during movement of the first and second railway car units with respect to one another between said straightened and angled positions, to stably support the vehicle on the platforms straddling the articulation during transport.

2. An articulated railway car in accordance with claim 1 further comprising:

first platform biasing means for biasing said first platform toward its straightened position with respect to the first railway car unit; and second platform biasing means for biasing said second platform toward its straightened position with respect to the second railway car unit.

3. An articulated railway car in accordance with claim 1 in which the first and second railway car units each have a first side and a second side, and the pivot plate assembly further comprises:

a first bridge plate slidably engaged to said first and second railway car units and disposed between the first and second platforms and the decks of their respective railway car units, adjacent the first side of the railway car units;

a second bridge plate slidably engaged to said first and second railway car units and disposed between the first and second platforms and the decks of their respective railway car units, adjacent the second side of the railway car units; and the first and second bridge plates providing respective supporting surfaces for rolling loading and unloading of vehicles over said articulation from one of said platforms to the other.

4. An articulated railway car in accordance with claim 3 in which the first and second railway car units each have pins and the first bridge plate and the second bridge plate each have a pair of collinear slots which receive a respective one of the pins of the first and second railway car units for sliding movement of the pins within their respective slots.

5. An articulated railway car in accordance with claim 1 in which said first platform biasing means comprises at least one spring extending between the first railway car unit and the first platform, and said second platform biasing means comprises at least one spring extending between the second railway car unit and the second platform.

6. An articulated railway car in accordance with claim 5 in which the first platform biasing means and the second platform biasing means each comprise a pair of springs disposed on either side of the pivotal engagement of the first and second platforms with their respective railway car units, each of the springs having one end fixed to a respective railway car unit and the other end fixed to a respective one of the first and second platforms.

7. An articulated railway car in accordance with claim 1 in which low friction pads are disposed between the railway car unit decks and their respective first and second platforms to maintain a predetermined spacing between the railway car units and their respective platforms and facilitate low friction pivotal movement of the platforms with respect to their respective railway car units.

8. An articulate railway car in accordance with claim 3 in which means for maintaining a predetermined spacing between the bridge pates and the platforms are disposed between the bridge plates and the first and second platforms to maintain a predetermined spacing between the bridge plates and the platforms.

9. An articulated railway car in accordance with claim 1 in which the pivotal connections of the pivotal platforms to their respective railway car units further comprises longitudinal displacement means for accommodating longitudinal displacement of the pivotal platforms relative to their respective railway car units.

10. An articulated railway car for cost-effective shipment of automotive vehicles comprising a pair of adjoining first and second vehicle-carrying railway car units and a pivot plate assembly for spanning said pair of adjoining first and second vehicle-carrying railway car units at their articulation to allow rolling loading and unloading of vehicles between the first and second units across the articulation, the rack comprising:

a first platform pivotably engaged to the first unit adjacent the end adjoining the second unit, to allow pivotal movement of the first platform between a straightened position in which the first platform extends generally parallel to the first unit and an angled position in which the first platform extends at an angle with respect to the first unit;

a second platform pivotably engaged to the second unit adjacent the end adjoining the first unit to allow pivotal movement of the second platform between a straightened position in which the second platform extends generally parallel to the second unit and an angled position in which the second platform extends at an angle with respect to the second unit;

a first bridge plate slidably engaged with the first and second units and disposed between the first and second platforms and their respective units adjacent the first side of the units;

a second bridge plate slidably engaged with said first and second units and disposed between the first and second platforms and their respective units adjacent the second side of the units;

first platform biasing means for biasing said first platform to its straightened position;

second platform biasing means for biasing said second platform to its straightened position; and the first and second platforms being in overlapping relation to both the first and second bridge plates during angular movement of the first unit with respect to the second unit to allow rolling loading and unloading of vehicles across the articulation both with the first car extending at an angle, and extending parallel with respect to, the second unit.

11. An articulated railway car in accordance with claim 10 in which the pivotal connections of the pivotal platforms to their respective railway units further comprises longitudinal displacement means for accommodating longitudinal displacement of the pivotal platforms relative to their respective units.

12. An articulated car for transporting vehicles by rail, comprising:

a first vehicle-transporting railway car unit;

a second vehicle-transporting railway car unit pivotably connected to said first railway car unit to allow movement of the first and second railway car units between a straight position in which the railway car units are generally collinear with respect to one another and an angled position in which the railway car units are angled with respect to one another, said first and second railway car units having respective longitudinal axes and railway car unit decks;

a first platform having a longitudinal axis and being pivotably engaged to the first railway car unit adjacent the end thereof adjoined to the second railway car unit, to allow pivotal movement of the first platform between a straightened position in which the longitudinal axis of the first platform aligns with the longitudinal axis of the first railway car unit and an angled position in which the longitudinal axis of the first platform extends at an angle with respect to the longitudinal axis of the first railway car unit;

a second platform having a longitudinal axis and being pivotably engaged to the second railway car unit adjacent the end thereof adjoined to the first railway car unit to allow pivotal movement of the second platform between a straightened position in which the longitudinal axis of the second platform aligns with the longitudinal axis of the second railway car unit, and an angled position in which the longitudinal axis of the second platform extends at an angle with respect to the longitudinal axis of the second railway car unit;

said first and second platforms each having means for engaging a respective one of the front and rear portions of a vehicle straddling the articulation; and the first and second platforms being maintainable in substantially collinear relation to one another by the vehicle during movement of the first and second railway car units with respect to one another between said straightened and angled positions, to stably support the vehicle on the platforms straddling the articulation during transport.

13. An articulated car in accordance with claim 12 further comprising:

first platform biasing means for biasing said first platform toward its straightened position with respect to the first railway car unit; and second platform biasing means for biasing said second platform toward its straightened position with respect to the second railway car unit.

14. An articulated car in accordance with claim 12 in which the first and second railway car units each have a first side and a second side, and the pivot plate assembly further comprises:

a first bridge plate slidably engaged to said first and second railway car units and disposed between the first and second platforms and the decks of their respective railway car units, adjacent the first side of the railway car units;

a second bridge plate slidably engaged to said first and second railway car units and disposed between the first and second platforms and the decks of their respective railway car units, adjacent the second side of the railway car units; and the first and second bridge plates providing respective supporting surfaces for rolling loading and unloading of vehicles over said articulation from one of said platforms to the other.

15. An articulated car in accordance with claim 12 in which the pivotal connections of the pivotal platforms to their respective railway car units further comprises longitudinal displacement means for accommodating longitudinal displacement of the pivotal platforms relative to their respective railway car units.

16. An articulated car in accordance with claim 14 wherein each said first and second platforms comprises a base portion supported on a deck of the railway car, and an undercut portion having a bottom surface spaced from the deck by approximately the thickness of one of said bridge plates, said undercut portion overlapping one of said bridge plates and supported thereon.

17. An articulated car in accordance with claim 16 wherein each of said platforms is molded from a polymeric material and has a ribbed bottom surface.

18. An articulated car in accordance with claim 14 wherein each of said bridge plates is molded from a polymeric material and has a ribbed bottom surface.

19. An articulated railway car for transporting automotive vehicles by rail comprising first and second car units, each of said first and second car units having a swivel plate assembly adjacent the articulation for supporting the front or rear wheels of a vehicle, each swivel plate assembly comprising a durable, low-friction surface which enables slidable and pivotable support of the swivel plate on its respective associated car unit, each swivel plate assembly further comprising means for securely holding an automotive vehicle to the swivel plate assembly, wherein each swivel plate assembly is capable of supporting one end of a vehicle on a respective one of said units, and said swivel plate assemblies, in combination, are capable of supporting opposite ends of a single vehicle spanning the articulation.

20. An articulated railway car for transporting vehicles by rail comprising first and second car units, each of said first and second car units having a swivel plate assembly adjacent the articulation for supporting the front or rear wheels of a vehicle, whereby each swivel plate assembly may be used to support one end of a vehicle on a respective one of said units, or alternatively, said swivel plate assemblies may be combined to support opposite ends of a single vehicle spanning the articulation, wherein said swivel plate assemblies comprise a pair of pivotal platform assemblies and a pair of bridge plates, each of said platform assemblies comprising a pair of platforms molded from a polymeric material and having a ribbed bottom surface, and each of said bridge plates being molded from a polymeric material and having a ribbed bottom surface.

* * * * *